US011109662B2

(12) United States Patent
Marolia

(10) Patent No.: US 11,109,662 B2
(45) Date of Patent: Sep. 7, 2021

(54) BACKPACK

(71) Applicant: Sunil Marolia, Laguna Niguel, CA (US)

(72) Inventor: Sunil Marolia, Laguna Niguel, CA (US)

(73) Assignee: Sunil Marolia, Laguna Niguel, CA (US)

( * ) Notice: Subject to any disclaimer, the term of this patent is extended or adjusted under 35 U.S.C. 154(b) by 0 days.

(21) Appl. No.: 16/833,605

(22) Filed: Mar. 29, 2020

(65) Prior Publication Data

US 2020/0323331 A1 Oct. 15, 2020

Related U.S. Application Data

(60) Provisional application No. 62/831,359, filed on Apr. 9, 2019.

(51) Int. Cl.

| | |
|---|---|
| ***A45F 3/04*** | (2006.01) |
| ***A45F 4/02*** | (2006.01) |
| ***A47D 13/02*** | (2006.01) |

(52) U.S. Cl.

CPC ..... *A45F 3/047* (2013.01); *A45F 4/02* (2013.01); *A47D 13/025* (2013.01); *A45F 2004/026* (2013.01)

(58) Field of Classification Search

CPC ..... A45F 3/047; A45F 4/02; A45F 2004/026; A45F 2003/045; A45F 3/04; A47D 13/025; A45C 2009/002; A47C 1/146; A47C 4/52

USPC ..... 224/155

See application file for complete search history.

(56) References Cited

U.S. PATENT DOCUMENTS

| | | | | |
|---|---|---|---|---|
| 5,318,342 A * | 6/1994 | Hale | A47C 4/52 297/129 |
| 5,816,662 A * | 10/1998 | Rumburg | A47D 15/006 297/484 |
| 2005/0133560 A1* | 6/2005 | Taylor | A47D 13/025 224/630 |
| 2005/0168026 A1* | 8/2005 | Kau | A45C 15/00 297/256.16 |
| 2009/0090751 A1* | 4/2009 | D'Alessandro | A45F 4/02 224/155 |

* cited by examiner

*Primary Examiner* — Nathan J Newhouse
*Assistant Examiner* — Matthew T Theis
(74) *Attorney, Agent, or Firm* — Dragon Sun Law Firm, PC; Jinggao Li, Esq.

(57) ABSTRACT

A backpack includes a support portion adapted to be supported on shoulders of a wearer and a bag portion having at least one compartment for storing one or more articles. The bag portion is pivotally coupled to the support portion and adapted to pivot between a first position and a second position relative to the support portion. In the first position, the bag portion is disposed along the support portion and abuts the support portion and, in the second position, the bag portion is disposed substantially perpendicular to the support portion and provides a seat for facilitating a seating of a child.

19 Claims, 6 Drawing Sheets

BACKPACK

CROSS-REFERENCE TO RELATED APPLICATIONS

This application claims priority from U.S. Provisional Application No. 62/831,359 filed on Apr. 9, 2019, titled "A Convertible Backpack Child Carrier".

TECHNICAL FIELD

The present disclosure relates, generally, to a backpack. More particularly, the present disclosure pertains to a backpack adapted to provide a seat for facilitating a sitting for a child.

BACKGROUND

Families with children in an age group of 2-6 years of age have a limit to the length of hiking or any another outdoor activities. The constraints are imposed due to the fact that children will tire more rapidly and will have shorter strides compared to their adult counterparts. Typically, the carriers for the children are bulky and do not have storage capacities so a wearer may require additional unit for carrying one or more articles along with the child.

SUMMARY

According to an aspect of the disclosure a backpack is disclosed. The backpack includes a support portion adapted to be supported on shoulders of a wearer, and a bag portion having at least one compartment for storing one or more articles. The bag portion is pivotally coupled to the support portion and is adapted to pivot between a first position and a second position relative to the support portion. In the first position, the bag portion is disposed along the support portion and abuts the support portion. In the second position, the bag portion is disposed substantially perpendicular to the support portion and provides a seat for facilitating a seating of a child.

In an embodiment, the backpack further includes a latch for holding the bag portion in the first position.

In an embodiment, the latch includes a first member attached to the bag portion and a second member attached to the support portion. The first member is configured to engage with the second member to hold the bag portion in the first position.

In an embodiment, the backpack further includes a retention structure for retaining the bag portion in the second position.

In an embodiment, the retention structure includes a first retention member attached to the support portion and a second retention member attached to the bag portion. The first retention member is coupled to the second retention member to retain the bag portion in the second position.

In an embodiment, the support portion includes a frame pivotally coupled to the bag portion and a pair of straps coupled to the frame and adapted to support the backpack on the shoulders of the wearer.

In an embodiment, the support portion includes a sternum strap extending between the pair of straps and joining the pair of straps. The sternum strap is adapted to abut a sternum portion of the wearer.

In an embodiment, the support portion includes a waist strap extending from a first lateral end of the frame to a second lateral end of the frame. The waist strap is adapted to abut a waist of the wearer and supports the backpack on hips of the wearer.

In an embodiment, the bag portion includes a storage portion defining the at least one compartment for storing the one or more articles and a back portion attached to the storage portion and pivotally coupled to the support portion. A surface of the back portion defines a seating surface of the seat.

In an embodiment, the backpack further includes a multipoint harness adapted to secure the child sitting on the bag portion.

In an embodiment, the backpack further includes a clip attached to the support portion and adapted to engage with the multipoint harness to secure the child sitting on the bag portion.

In an embodiment, the backpack further includes a pair of safety straps coupled to the support portion and the bag portion. The pair of safety straps is adapted to receive a pair of legs of the child to facilitate a securement of the child on the seat.

In an embodiment, the backpack further includes a pair of foot strips attached to the support portion adapted for supporting the child while climbing on the seat.

In another aspect a backpack is disclosed. The backpack includes a support portion adapted to be supported on shoulders of a wearer and a bag portion having at least one storage compartment for storing one or more articles. The bag portion is adapted to pivot between a first position and a second position relative to the support portion. Also, the backpack includes a latch for holding the bag portion in the first position and a retention structure for retaining the bag portion in the second position. In the first position, the bag portion is disposed along the support portion and abuts the support portion. In the second position, the bag portion is disposed substantially perpendicular to the support portion and provides a seat for facilitating a seating of a child In an embodiment, the latch includes a first member attached to the bag portion and a second member attached to the support portion. The first member is configured to engage with the second member to hold the bag portion in the first position.

In an embodiment, the retention structure includes a first retention member attached to the support portion and a second retention member attached to the bag portion. The first retention member is coupled to the second retention member to retain the bag portion in the second position.

In an embodiment, the support portion includes a frame pivotally coupled to the bag portion and a pair of straps coupled to the frame and adapted to support the backpack on the shoulders of the wearer.

In an embodiment, the bag portion includes a storage portion defining the at least one compartment for storing the one or more articles and a back portion attached to the storage portion and pivotally coupled to the support portion. A surface of the back portion defines a seating surface of the seat.

In an embodiment, the backpack further includes a multipoint harness adapted to secure the child sitting on the bag portion.

In an embodiment, the backpack further including a clip attached to the support portion and adapted to engage with the multipoint harness to secure the child sitting on the bag portion.

BRIEF DESCRIPTION OF THE DRAWINTS

DETAILED DESCRIPTION

Figure 1:
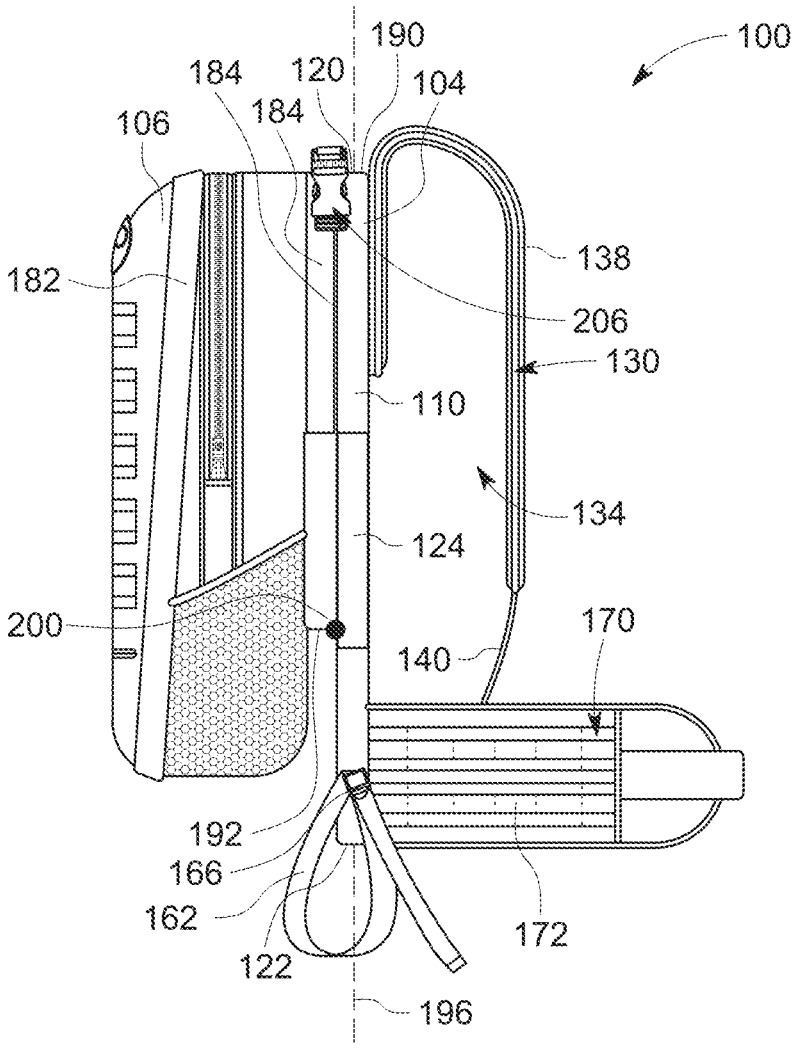
FIG. 1 illustrates a side view of a backpack, in accordance with an embodiment of the disclosure.

Referring to FIG. 1 to FIG. 4, a backpack 100 suitable for storing one or more articles and providing a seat 102 for facilitating a carrying of a person, such as, a child 300, by a wearer of the backpack 100 is shown. The backpack 100 includes a support portion 104 adapted to be supported on a wearer's shoulders and hips and a bag portion 106 having at least one compartments for facilitating a storage of the one or more articles. The bag portion 106 is adapted to pivot relative to the support portion 104 and moves/pivots in a first position and a second position relative to the support portion 104. In the first position, the bag portion 106 is disposed along the support portion 104 and abuts the support portion 104, while in the second position, the bag portion 106 is disposed substantially perpendicular to the support portion 104 and provides the seat 102 for facilitating a seating of a child. The support portion 104 may include a frame 110 or panel and a pair of straps attached from the frame 110. The frame 110 is adapted to be disposed substantially along a back of the wearer when the backpack 100 is worn by the wearer. In an embodiment, the frame 110 may include pads or soft material to provide cushioning effect to the wearer of the backpack 100. As shown, in an embodiment, the frame 110 may be a rectangular frame having a first longitudinal end 120, a second longitudinal end 122 disposed opposite to the first longitudinal end 120, a first lateral end 124, and a second lateral end 126 disposed opposite the first lateral end 124. Moreover, in some embodiments, the frame 110 may include one or more battens (not shown), to provide rigidity to the frame 110. The battens may extend along a width and/or a length of the frame 110 and may be made of fiberglass, vinyl, carbon fiber or similar lightweight semi-flexible material, or any other suitable materials. The battens may be sewn into the frame 110 to provide adequately rigid structure.

The pair of straps, for example, a first strap 130 and a second strap 132, extends in a longitudinal direction and are coupled proximate to the first longitudinal end 120 and the second longitudinal end 122 of the frame 110. The first strap 130 defines a first opening 134 to receive a first shoulder of the wearer, while the second strap 132 defines a second opening 136 to receive a second shoulder of the wearer. Further, the first strap 130 may include a first portion 138, a second portion 140, and a buckle 142 removable coupling the first portion 138 to the second portion 140. As shown, the first portion 138 is attached to the first longitudinal end 120 of the frame 110, while the second portion 140 is attached to the second longitudinal end 122 of the frame 110. The buckle 142 also facilitates in adjusting a diameter of the first opening 134 by facilitating an adjustment of a length of the first portion 138 extending between the first longitudinal end 120 and the buckle 142 and/or an adjustment of a length of the second portion 140 extending between the second longitudinal end 122 and the buckle 142. In some implementations, the first portion 138 includes padding to provide cushioning to the shoulders of the wearer when the first strap 130 is worn by the wearer. Similar to the first strap 130, the second strap 132 may include a first portion 148, a second portion 150, and a buckle 152 removable coupling the first portion 148 to the second portion 150. As shown, the first portion 148 is attached to the first longitudinal end 120 of the frame 110, while the second portion 150 is attached to the second longitudinal end 122 of the frame 110. The buckle 152 also facilitates in adjusting a diameter of the second opening 136 by facilitating an adjustment of a length of the first portion 148 extending between the first longitudinal end 120 and the buckle 152 and/or an adjustment of a length of the second portion 150 extending between the second longitudinal end 122 and the buckle 152. In some implementations, the first portion 148 includes padding to provide cushioning to the shoulder of the wearer when the second strap 132 is worn by the wearer.

Additionally, or optionally, the support portion 104 includes a sternum strap 156 extending from the first strap 130 to the second strap 132 and joining the pair of straps 130, 132. The sternum strap 156 is adapted to abut or contact a sternum portion of the wearer and may include a padded portion to provide cushioning to the wearer and facilitates an even distribution of the weight. As the sternum strap 156 may include two straps and a coupler 160 for selectively or removably attaching the two straps together. Further, the support portion 104 may include a pair of foot strips including a first foot strip 162 coupled to the first lateral end 124 and disposed proximate to the second longitudinal end 122 and a second foot strip 164 attached to the second lateral end 126 and positioned proximate to the second longitudinal end 122. The pair of foot strips 162, 164 forms a closed loop of adjustable length and facilitates for placing feet of the child 300. In addition, the first foot strip 162 includes a first slider buckle 166 for facilitating an adjustment of a length of the loop. Similarly, the second foot strip 164 includes a second slider buckle (not shown) for facilitating an adjustment of a length of a loop. Furthermore, the support portion 104 may include a waist strap 170 extending from the first lateral end 124 to the second lateral end 126 and adapted to abut or contact a waist of the wearer. The waist strap 170 includes a first strap portion 172 extending from the first lateral end 124, a second strap portion 174 extending from the second lateral end 126 and removable coupled to the first strap portion 172, a coupling mechanism 176 for removable coupling the first strap portion 172 to the second strap portion 174. The coupling mechanism 176 may include a female coupler 178 attached to the first strap portion 172 and a male coupler 180 attached to the second strap portion 174 and adapted to receive the male coupler 180 for engaging/securing the first strap portion 172 to the second strap portion 174. In an embodiment, the first strap portion 172 and the second strap portion 174 may include padding to provide cushioning to the waist of the wearer. In an embodiment, the first strap portion 172 and the second strap portion 174 may include a PALS (Pouch Attachment Ladder System) webbing strap for facilitating an attachment of one or more accessories.

Referring to FIG. 1 to FIG. 4, the bag portion 106 includes a storage portion 182 and a back portion 184 adapted to abut the frame 110 of the support portion 104. The storage portion 182 includes the at least one compartment for facilitating a storage of the one or more articles, while the back portion 184 includes a surface 185 defining a seating surface 186 of the seat 102 for facilitating the seating of the child 300. The back portion 184 includes a first longitudinal end 190 (free end) and a second longitudinal end 192 pivotally coupled to the frame 110 at a location proximate to the second longitudinal end 122 of the frame 110, thereby facilitating a pivotal movement of the bag portion 106 relative to the support portion 104 about a pivot axis 194. As shown, the pivot axis 194 extends substantially parallel to a surface 195 of the frame 110 and is substantially perpendicular to a longitudinal axis 196 of the frame 110. In an embodiment, the bag portions 106 (i.e. the back portion 184) is pivotally coupled to the support portion 104 (i.e. the frame 110) via a hinge 200. The hinge 200 may be formed by sewing the second longitudinal end 192 of the back portion 184 to the frame 110. In the first position (shown in FIG. 1), the bag portion 106 is disposed substantially parallel to the frame 110 such that the back portion 184 abuts the frame 110 and the first longitudinal end 190 of the back portion 184 is disposed proximate to the first longitudinal end 120 of the frame 110. Moreover, in the second position (shown in FIG. 2), the bag portion 106 is disposed substantially perpendicular to the frame 110 such that the back portion 184 provides the seating surface 186 for facilitating a seating of the child 300. In the second position, the first longitudinal end 190 of the back portion 184 is disposed away from the first longitudinal end 120 of the frame 110. Accordingly, when the backpack 100 is worn by the wearer, the bag portion 106, in the first position, is disposed along a back of the wearer, while the bag portion 106, in the second position, is disposed substantially perpendicular to the back of the wearer. In this manner, in the second position, the bag portion 106 (i.e. the back portion 184) acts as the seat 102 on which the child 300 may sit. Further, in some implementations, the back portion 184 may include one or more battens (not shown), to provide rigidity to the seat 102. The battens may extend along a width and/or a length of the back portion 184. In an embodiment, the battens may include semi rigid structures and may be made of fiberglass, vinyl, carbon fiber or similar lightweight semi-flexible material, or any other suitable materials. The battens may be sewn into the back portion 184 to provide adequately rigid structure so that the bag portion 106 does not collapse on itself when a child 300 sits on the seat 102.

Figure 2:
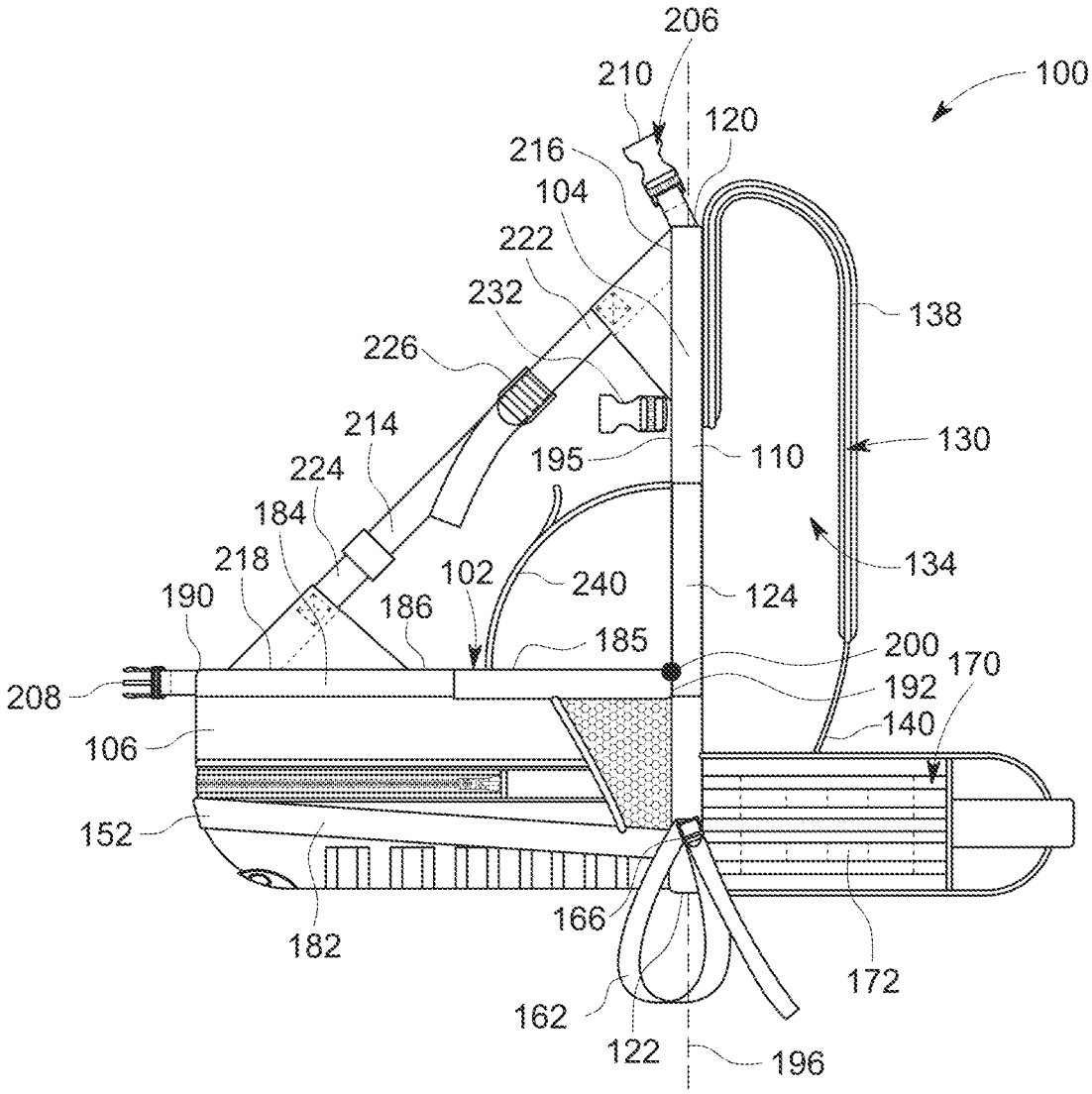
FIG. 2 illustrates a perspective view of the backpack in a position to be use as a seat, in accordance with an embodiment of the disclosure.
Figure 3:
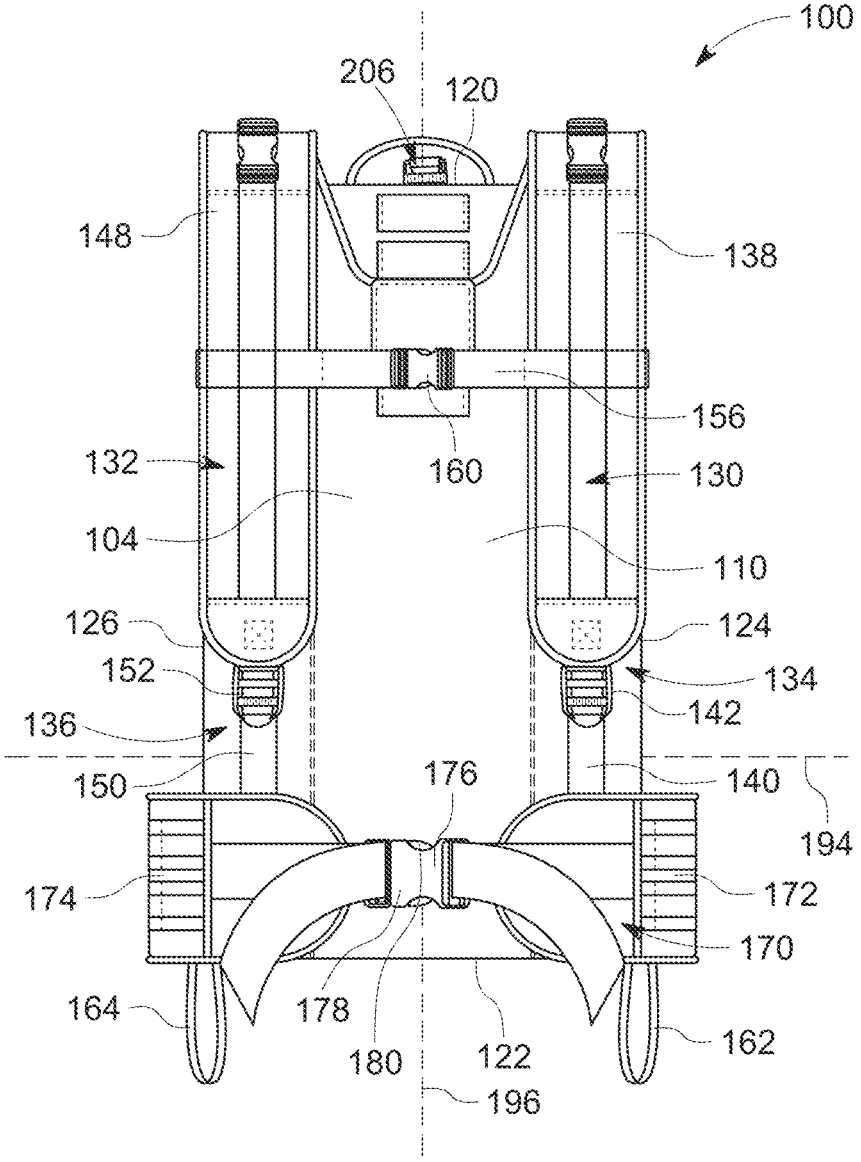
FIG. 3 illustrates a perspective view of the backpack, in accordance with an embodiment of the disclosure.
Figure 4:
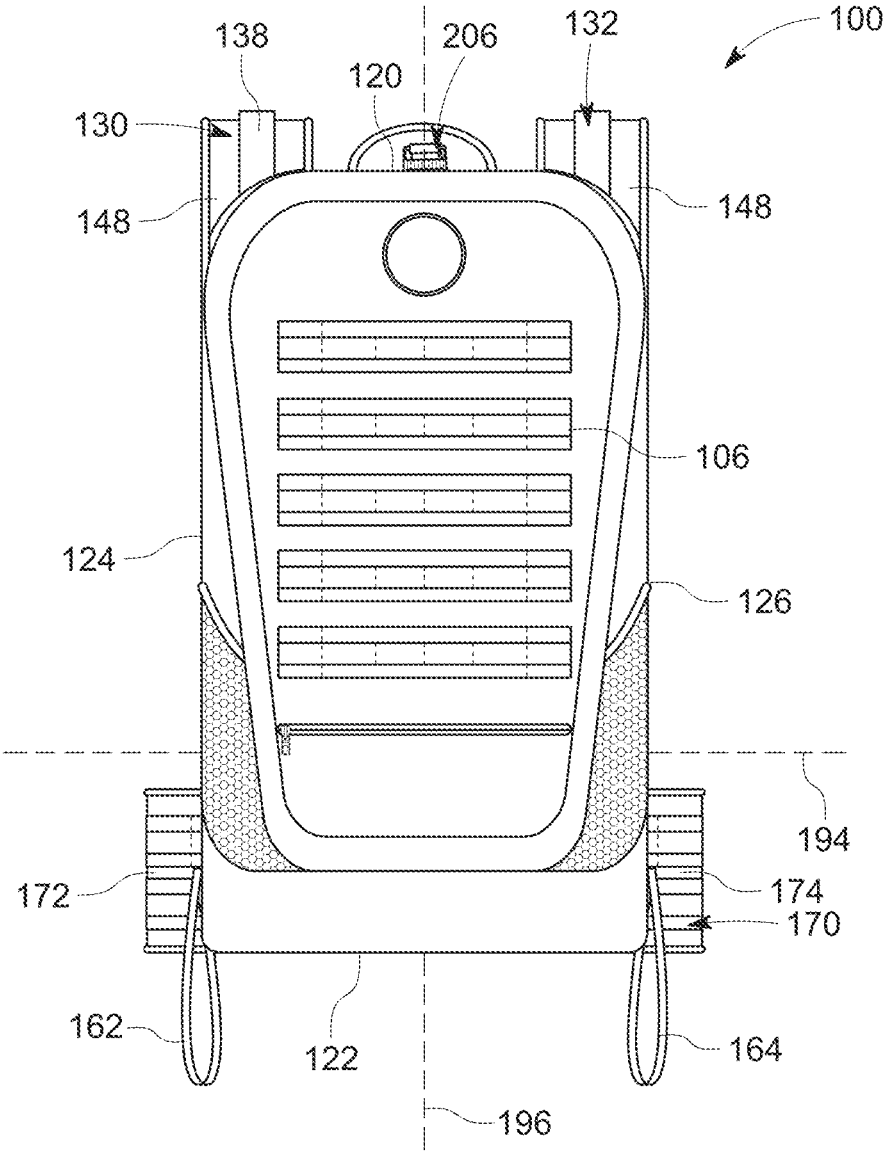
FIG. 4 illustrates a perspective view of the backpack, in accordance with an embodiment of the disclosure.

Referring to FIG. 2, the backpack 100 may include a latch 206 to hold the bag portion 106 in the first position. As shown, the latch 206 may include a first member 208 having flexible fingers attached to the back portion 184 and a second member 210 having housing defining a cavity to receive the flexible fingers and attached to the frame 110. To hold the bag portion 106 in the first position, the first member 208 is engaged to the second member 210 such that the first member 208 is disposed inside the second member 210 and engaged in a latched position. To move the bag portion 106 to second position, the first member 208 is disengaged from the second member 210 by pressing the flexible fingers and subsequently removing the fingers from the second member 210. Additionally, or optionally, the latch 206 may include a pair of magnets for facilitating a temporary engagement of the bag portion 106 with the frame 110 in the first position. In such a case, a first magnet may be attached to the frame 110 and may be sewn inside the frame 110, while a second magnet may be attached to the back portion 184 and may be sewn inside the back portion 184. Moreover, the backpack 100 includes at least one retention structure 214 for retaining and holding the bag portion 106 in the second position. In an embodiment, the retention structure 214 may be a strap extending from the frame 110 to the back portion 184. As shown, an end 216 of the retention structure 214 may be attached proximate to the first longitudinal end 120 of the frame 110, while the other end 218 of the retention structure 214 is attached proximate to the first longitudinal end 190 of the back portion 184. In an embodiment, the retention structure 214 may include a first retention member 222 attached to the frame 110 and a second retention member 224 removably coupled to the first retention member 222 and attached to the back portion 184. To removably couple the first retention member 222 to the second retention member 224, the retention structure 214 may include a retention buckle 226, which may be a single bar buckle, to receive a portion of the first retention member 222 and a portion of the second retention member 224. Further, the retention buckle 226 may facilitate in adjustment of a length of the retention structure 214 extending between the back portion 184 and the frame 110 by facilitating an adjustment of a length of the first retention member 222 extending between the frame 110 and the retention buckle 226 and/or an adjustment of a length of the second retention member 224 extending between the back portion 184 and the retention buckle 226. In an embodiment, the first retention member 222 and the second retention member 224 are straps extending from the frame 110 and the back portion 184 respectively. Although a single retention structure 214 is shown and contemplated, it may be appreciated that the backpack 100 may include two retention structures or more than two retention structures to hold the bag portion 106 in the second position. Further, when the backpack 100 includes two retention structures, each retention structure may define an opening to receive one or the pair of legs of the child 300 when the child 300 is seated on the seat 102.

Figure 5:
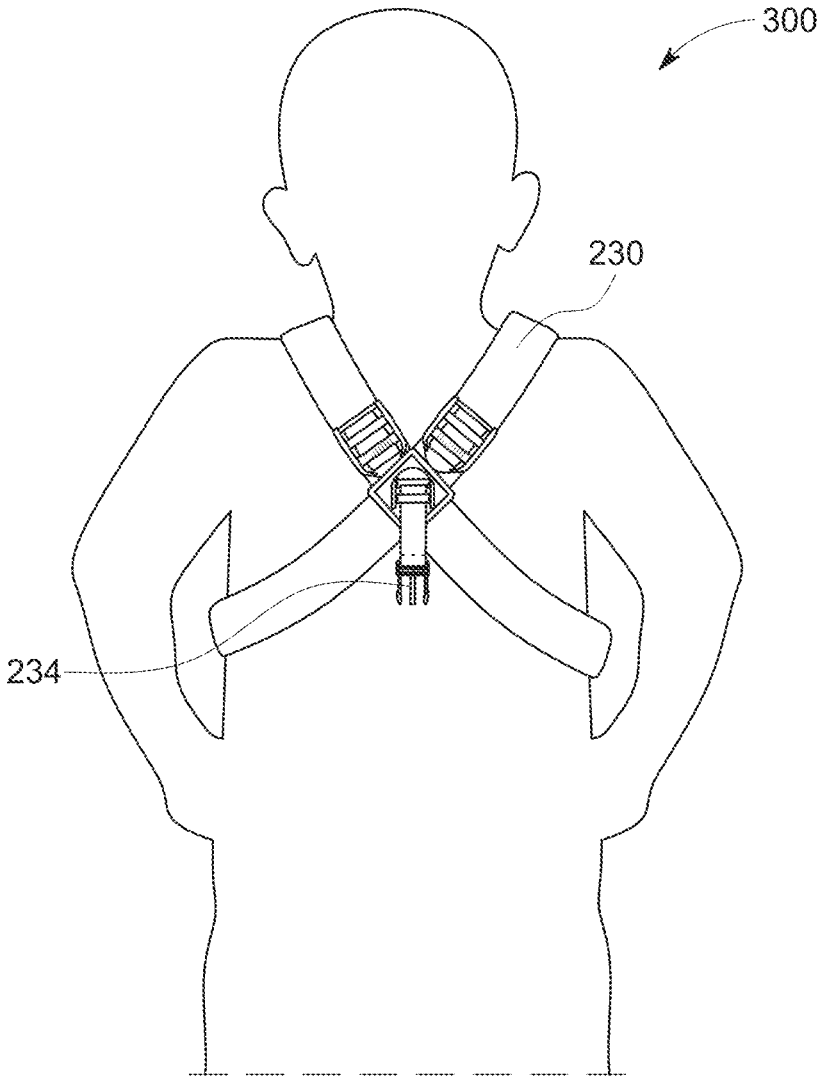
FIG. 5 illustrates a perspective view of a child wearing a multi-point harness, in accordance with an embodiment of the disclosure.
Figure 6:
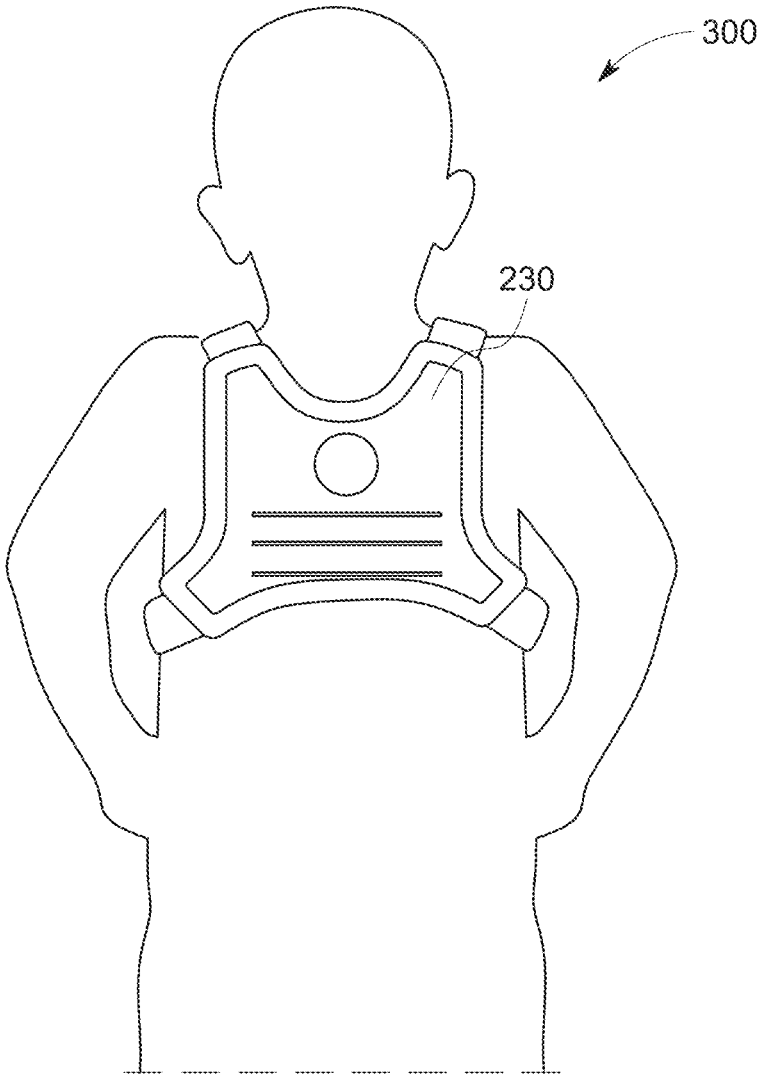
FIG. 6 illustrates a perspective view of the child wearing the multi-point harness, in accordance with an embodiment of the disclosure.

Referring to FIG. 5 and FIG. 6 the backpack 100 may include a multipoint harness 230, for example a four point harness, adapted to be removably attached to a clip 232. In an embodiment, the clip is attached to the frame 110. The multipoint harness 230 is adapted to be worn by the child 300 for seating on the seat 102, and is attached to the clip 232 via a tether 234 to support/secure the child 300 on the seat 102 and prevent a falling of the child 300 from the backpack 100. Further, the backpack 100 may include a pair of safety leg straps 240 attached to the back portion 184 and the frame 110 and adapted to receive and support the legs of the child 300 seated on the bag portion 106. In an embodiment, each safety leg strap 240 may include one or more buckles for facilitating an adjustment of a length of the associated safety leg strap 240.

A method for using the backpack 100 for carrying the child 300 by the wearer is now explained. At first, the wearers hold the backpack 100 by supporting/engaging the pair of straps 130, 132 on his shoulders. The wearer may also attach the waist strap 170 around his waist and the sternum strap 156 around the sternum of the wearer for supporting the backpack 100. For utilizing the backpack 100 for carrying the child 300, the bag portion 106 is moved from the first position to the second position. For so doing, the wearer may disengage the first member 208 from the second member 210 and thereby positioning the bag portion 106 in a substantially horizontal position. Accordingly, the bag portion 106, in the second position, provides as the seat 102 for facilitating a seating of the child 300. For securing the child 300 with the backpack 100, the multipoint harness 230 is attached around a chest of the child 300 and connected to the clip 232 using the tether 234. Further, the legs of the child 300 may be inserted or engaged with the safety leg straps 240 to secure the child 300 with the backpack 100. In this manner, the backpack 100 facilitates in carrying the child 300 on a back of the wearer along with storing one or more articles.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The exemplary embodiment was chosen and described in order to best explain the principles of the present disclosure and its practical application, to thereby enable others skilled in the art to best utilize the present disclosure and various embodiments with various modifications as are suited to the particular use contemplated.

LIST OF ELEMENTS

100 backpack
102 seat
104 support portion
106 bag portion
110 frame
120 first longitudinal end
122 second longitudinal end
124 first lateral end
126 second lateral end
130 first strap
132 second strap
134 first opening
136 second opening
138 first portion
140 second portion
142 buckle
148 first portion
150 second portion
152 buckle
156 sternum strap
160 coupler
162 first foot strip
164 second foot strip
166 first slider buckle
170 waist strap
172 first strap portion
174 second strap portion
176 coupling mechanism
178 female coupler
180 male coupler
182 storage portion
184 back portion
185 surface
186 seating surface
190 first longitudinal end
192 second longitudinal end
194 pivot axis
195 surface
196 longitudinal axis
200 hinge
206 latch
208 first member
210 second member
214 retention structure
216 end
218 end
222 first retention member
224 second retention member
226 retention buckle
230 multi point harness
232 clip
234 tether
240 safety leg strap
300 child

What is claimed is:

1. A backpack comprising:

a support portion adapted to be supported on shoulders of a wearer;

a bag portion having at least one compartment for storing one or more articles, the bag portion pivotally coupled to the support portion and adapted to pivot between a first position and a second position relative to the support portion, wherein the bag portion pivots between the first position and the second position when the support portion is supported on the shoulders on the wearer and facilitates a carrying of a child by the wearer, wherein in the first position, the bag portion is disposed along the support portion and abuts the support portion, in the second position, the bag portion is disposed perpendicular to the support portion and provides a seat for facilitating a seating of the child; and a pair of foot strips attached to the support portion to facilitate a placing of feet of the child.

2. The backpack of claim 1 further including a latch for holding the bag portion in the first position.

3. The backpack of claim 2, wherein the latch includes a first member attached to the bag portion and a second member attached to the support portion, wherein the first member is configured to engage with the second member to hold the bag portion in the first position.

4. The backpack of claim 1 further including a retention structure for retaining the bag portion in the second position.

5. The backpack of claim 4, wherein the retention structure includes a first retention member attached to the support portion and a second retention member attached to the bag portion, wherein the first retention member is coupled to the second retention member to retain the bag portion in the second position.

6. The backpack of claim 1, wherein the support portion includes a frame pivotally coupled to the bag portion, and a pair of straps coupled to the frame and adapted to support the backpack on the shoulders of the wearer.

7. The backpack of claim 6, wherein the support portion includes a sternum strap extending between the pair of straps and joining the pair of straps, wherein the sternum strap is adapted to abut a sternum portion of the wearer.

8. The backpack of claim 6, wherein the support portion includes a waist strap extending from a first lateral end of the frame to a second lateral end of the frame, wherein the waist strap is adapted to abut a waist of the wearer.

9. The backpack of claim 1, wherein the bag portion includes a storage portion defining the at least one compartment for storing the one or more articles, and a back portion attached to the storage portion and pivotally coupled to the support portion, wherein a surface of the back portion defines a seating surface of the seat.

10. The backpack of claim 1 further including a multipoint harness adapted to secure the child sitting on the bag portion.

11. The backpack of claim 10 further including a clip attached to the support portion and adapted to engage with the multipoint harness to secure the child sitting on the bag portion.

12. The backpack of claim 1 further including a pair of safety straps coupled to the support portion and the bag portion, the pair of safety straps is adapted to receive a pair of legs of the child to facilitate a securement of the child on the seat.

13. A backpack comprising:

a support portion adapted to be supported on shoulders of a wearer;

a bag portion having at least one storage compartment for storing one or more articles, the bag portion adapted to pivot between a first position and a second position relative to the support portion, wherein the bag portion pivots between the first position and the second position when the support portion is supported on the shoulders on the wearer and facilitates a carrying of a child by the wearer;

a latch for holding the bag portion in the first position;

a retention structure for retaining the bag portion in the second position, wherein, in the first position, the bag portion is disposed along the support portion and abuts the support portion, and in the second position, the bag portion is disposed perpendicular to the support portion and provides a seat for facilitating the seating of a child; and a pair of foot strips attached to the support portion to facilitate a placing of feet of the child.

14. The backpack of claim 13, wherein the latch includes a first member attached to the bag portion and a second member attached to the support portion, wherein the first member is configured to engage with the second member to hold the bag portion in the first position.

15. The backpack of claim 13, wherein the retention structure includes a first retention member attached to the support portion and a second retention member attached to the bag portion, wherein the first retention member is coupled to the second retention member to retain the bag portion in the second position.

16. The backpack of claim 13, wherein the support portion includes a frame pivotally coupled to the bag portion, and a pair of straps coupled to the frame and adapted to support the backpack on the shoulders of the wearer.

17. The backpack of claim 13, wherein the bag portion includes a storage portion defining the at least one compartment for storing the one or more articles, and a back portion attached to the storage portion and pivotally coupled to the support portion, wherein a surface of the back portion defines a seating surface of the seat.

18. The backpack of claim 13 further including a multipoint harness adapted to secure the child sitting on the bag portion.

19. The backpack of claim 18 further including a clip attached to the support portion and adapted to engage with the multipoint harness to secure the child sitting on the bag portion.

* * * * *